United States Patent [19]

Sakamoto et al.

[11] Patent Number: 4,594,005

[45] Date of Patent: Jun. 10, 1986

[54] FLUID MIXING METHOD AND APPARATUS

[75] Inventors: Osamu Sakamoto, Tokyo; Yasuhiko Tsuruta, Kamakura; Haruo Sasaki, Yokohama; Yasuo Tsukamoto, Tokyo; Kiyoshi Kudo, Yokohama, all of Japan

[73] Assignee: Taisei Corporation, Tokyo, Japan

[21] Appl. No.: 618,171

[22] Filed: Jun. 7, 1984

[30] Foreign Application Priority Data

Jun. 15, 1983 [JP] Japan ..... 58-105727

[51] Int. Cl.[4] ..... B01F 15/02; B01F 15/08

[52] U.S. Cl. ..... 366/177; 366/183; 366/336; 366/338

[58] Field of Search ..... 366/336, 337, 338, 339, 366/340, 176, 177, 150, 27, 33, 37, 349, 30, 34, 181, 182, 1, 348, 173, 174, 9, 341, 183

[56] References Cited

U.S. PATENT DOCUMENTS

| | | | |
|---|---|---|---|
| 2,661,194 | 12/1953 | Katovsich | 366/11 |
| 3,460,809 | 8/1969 | Hauss | 366/338 |
| 3,779,519 | 12/1973 | Anderson | 366/3 |
| 3,819,157 | 6/1974 | Markfelt | 366/177 |
| 3,874,643 | 4/1975 | Lorenian | 366/182 |
| 3,942,772 | 3/1976 | Smith | 366/348 |
| 4,046,358 | 9/1977 | Grimes | 366/176 |
| 4,049,241 | 9/1977 | Taniguchi | 366/341 |

FOREIGN PATENT DOCUMENTS

| | | | |
|---|---|---|---|
| 432524 | 8/1926 | Fed. Rep. of Germany | 366/9 |

*Primary Examiner*—R. W. Jenkins

*Attorney, Agent, or Firm*—Sughrue, Mion, Zinn, Macpeak & Seas

[57] ABSTRACT

An improved method and apparatus for mixing fluid and/or granular substances, whereby greater mutual dispersion of at least two substances is achieved by attaining greater turbulence while minimizing the required amount of mechanical structure. Each of at least two substances is fed at a different angle in a belt-shaped stream to a nozzle, under pressures according to the viscosity of each substance. After initial mutual dispersion is achieved in the nozzle, the mixture passes to a mixing tube having a varying cross-section along its length, the varying cross-section creating further turbulence of the mixture passing through the mixing tube, causing further dispersion of the substances within the mixture.

11 Claims, 14 Drawing Figures

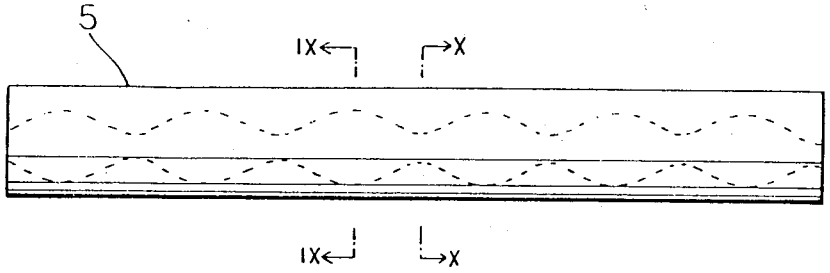
Fig 4
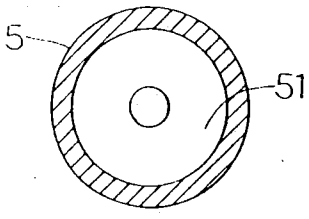
Fig 10
Fig 9

FLUID MIXING METHOD AND APPARATUS

BACKGROUND OF THE INVENTION

This invention concerns a method for achieving an ideal and total mixture of two different substances by employing a unique dispersion and agitation system. The substances to be mixed by this method are generally speaking liquids but extend to include powders and granular substances (from now on all will be refered to as fluids with 'liquid' being reserved for liquids only)

Normally, several kinds of fluids are placed in Y-shaped or X-shaped tubes and forced together; or they are mixed in one of the standard mixers. Occasionally fluids are mixed using both methods successively. However, as the viscosity of the fluids becomes greater there is a corresponding decline in the quality of the mixture. The amount of extra energy required therefore to achieve a good mix increases.

This tendency is particularly apparent when fluids of very different nature are mixed.

For this reason, when dynamic force is not employed for these kinds of fluids it is extremely difficult to get an even mix and the quality of the final product declines.

SUMMARY OF THE INVENTION

It is intended that this invention address exactly this problem. The type and property of fluid will not influence the quality of the mix. An economically superior continuous mixing method which simply and reliably produces high quality mixtures with a variety of fluids will be supplied.

This invention concerns a superior fluid mixing method whereby a fluid is jet sprayed in a belt shaped stream; at an angle perpendicular to and intersecting this stream is a second belt-shaped spray directed at the flat surface of the first fluid; after this, the fluids are agitated further to achieve a complete mix.

BRIEF DESCRIPTION OF THE DRAWINGS

The method and apparatus of the invention will be described in detail below with reference to the accompanying drawings, in which:

FIG. 4 shows one embodiment of the mixing pipe 5, having a varying cross-section;

FIGS. 9 and 10 are cross-sectional cut-away views of the mixing pipe 5, taken along lines IX—IX and X—X, respectively, in FIG. 4;

DETAILED DESCRIPTION OF THE INVENTION

The overall mechanism is made up of a confluence apparatus and an agitation apparatus.

Figure 1:
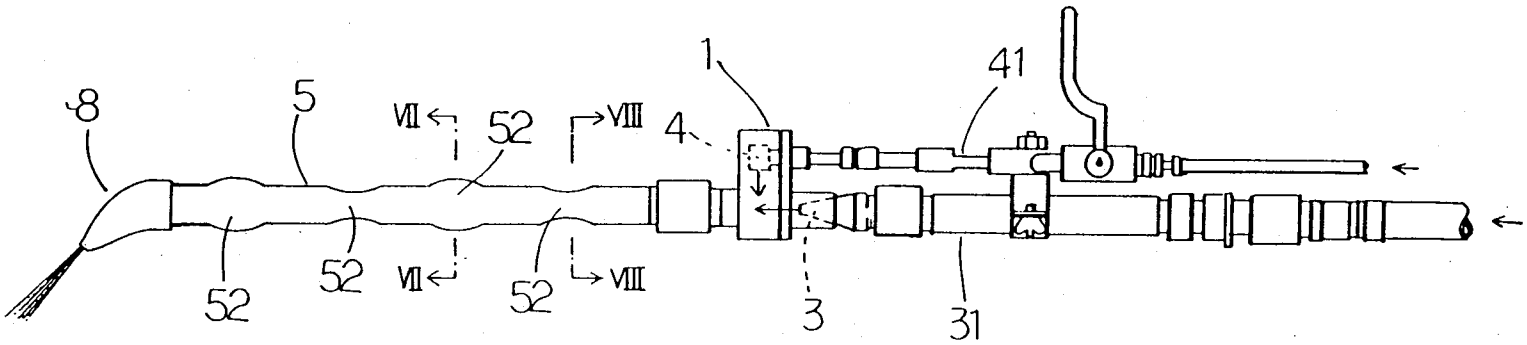
FIG. 1 is a diagram of an apparatus according to the invention.

As FIG. 1 indicates there are two pipes 31 and 41, coupled to nozzle 1. A horizontally directed slit nozzle 3 is attached to the end of pipe 31. A vertically directed (pointing down) slit nozzle 4 is attached to the end of pipe 41. Horizontally directed slit nozzle 3 is shaped so that its opening has the appearance of a squashed pipe. The opening is thus formed so that fluid discharged from the nozzle takes on a belt-like flattened shape.

Figure 2:
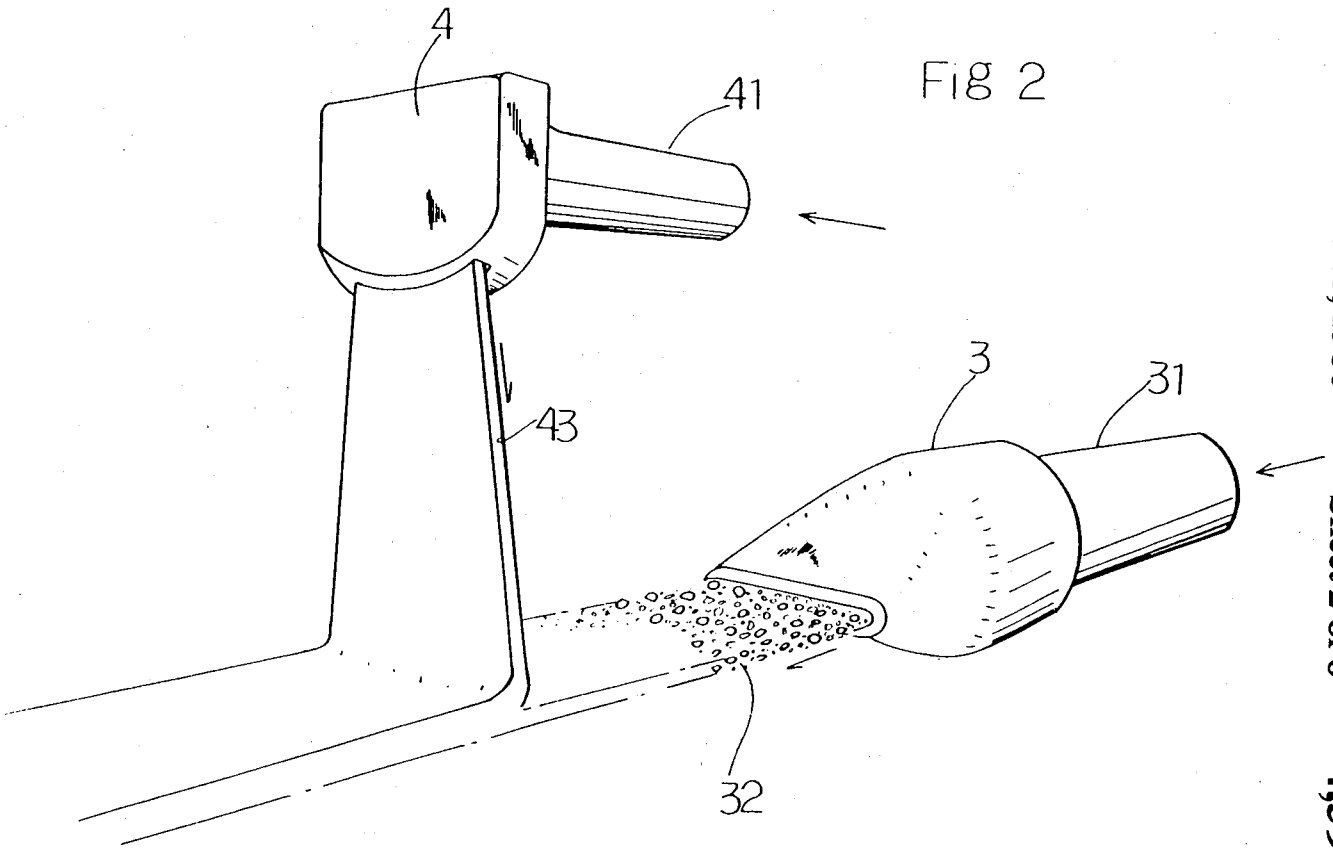
FIG. 2 shows the flow of fluid and granular material from the nozzles of the apparatus shown in FIG. 1.

As with horizontally directed slit nozzle 3, the opening of vertically directed slit nozzle 4 also has the squashed pipe appearance. When fluid is discharged from this nozzle 4 it takes on the same flattened shape 43 as shown in FIG. 2.

These respective nozzles 3, 4 are placed so that their sprays intersect.

The entire surface of the belt-shaped spray emitting from horizontally directed nozzle 3 encounters the entire surface of the belt-shaped spray emitting from vertically directed nozzle 4. The mutual coverage is similar to two paint rollers laying two strips of paint one over the other.

The reason the respective fluids are spray injected at each other in a belt-like shape is as follows.

If, for example, a cup of water were poured over a pile of sand, only a certain portion of the water would mix with the sand. Achieving complete mutual permeation is very difficult. With a higher viscosity fluid such as oil this tendency is even greater.

Consequently, a "mud pie" like constituency is often the result even if the mixture is agitated. To achieve an even mixture in this kind of situation a great amount of energy must be expended.

The basic reason for this is that the dispersion of the respective fluids is bad. If both agents are mixed in small amounts at a time in a way that lends itself to good mutual permeation, the subsequent agitation is an extremely simple and effective process. With a small amount of mixing energy a favorable mix can be achieved.

This invention concentrates particularly on the initial mutual dispersion of two mixing agents.

When fluid is sprayed in the manner described above its dispersion ability is enhanced and an appropriate mix can be achieved.

Figure 3:
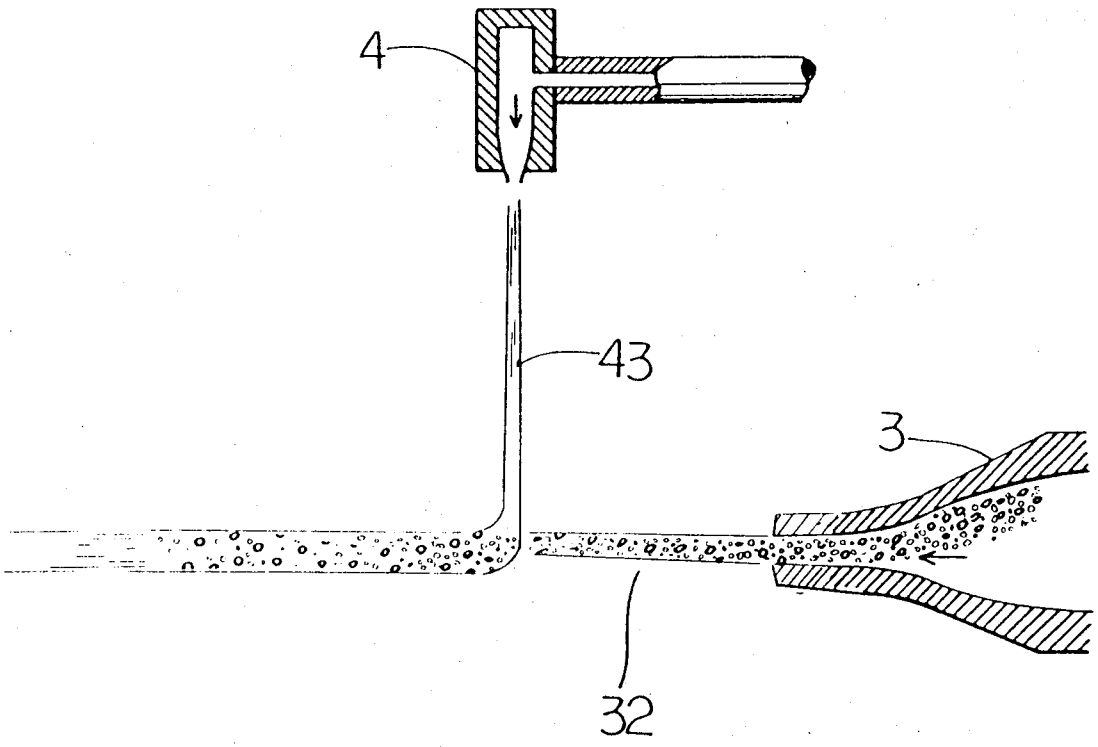
FIG. 3 also shows the confluence of material issuing from the nozzles 3 and 4, achieved by the apparatus of FIG. 1.

If, for example, a granular substance is sent under pressure to intersect another pressure sprayed liquid, the resulting mixture of the two substances is very good. The amount of liquid and its distribution to the granular substance is regular and even; a good dispersion that guarantees an ideal mixture (FIG. 3).

In other words this invention seeks to maximize the mutual permeation of the fluids to be mixed by achieving good initial dispersion and to this end employs a flattened jet spray system which shoots two intersecting belt-shaped sprays.

As FIG. 1 indicates, to one side of the overall mechanism there is a mixing pipe 5.

When the two fluids reach mixing pipe 5, they are already mixed to a certain degree by the confluence of jet sprays. The mixing pipe 5 is designed to ensure an even more complete mix.

Figure 7:
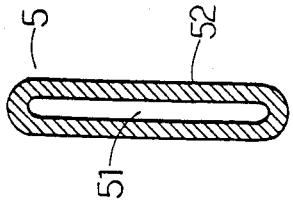
FIGS. 7 and 8 are cut-away views of the mixing pipe 5 along lines VII—VII and VIII—VIII, respectively, in FIG. 1.
Figure 8:
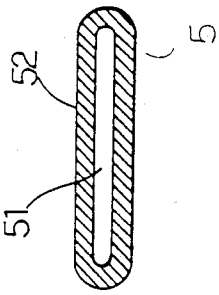

Pipe 5 has a continuous internal conduit 51. At fixed interval distances the internal conduit 51 is flattened to form wringers 52 as shown in FIGS. 1, 7, and 8.

The pipe is flattened alternatively top to bottom and then side to side so that the adjacent internal widths of the conduit at points 52 are perpendicular to each other.

It is also possible to mix more than two substances (liquids and/or granular substances) at once. To accomplish this, two vertically directed slit nozzles (one facing down, one up) and one horizontally directed slit nozzle are used.

The flattened jet sprays 43 and 53 of the two vertical spray nozzles 4 and 14 are aimed such that they intersect the horizontal spray on either side, as shown in FIG. 15.

The above example emphasizes the vertical and horizontal positioning of the respective sprays but the angles at which the sprays meet need not be set precisely in this way. They may be changed to other angles with no change in the effectiveness of the mix.

In contrast to the above embodiment, the diameter of conduit 51 may also gradually narrow and widen in a radial direction at fixed interval distances as shown in FIGS. 4, 7, and 10, rather than assuming the squashed pipe configuration of the example outlined in FIG. 1.

Figure 5:
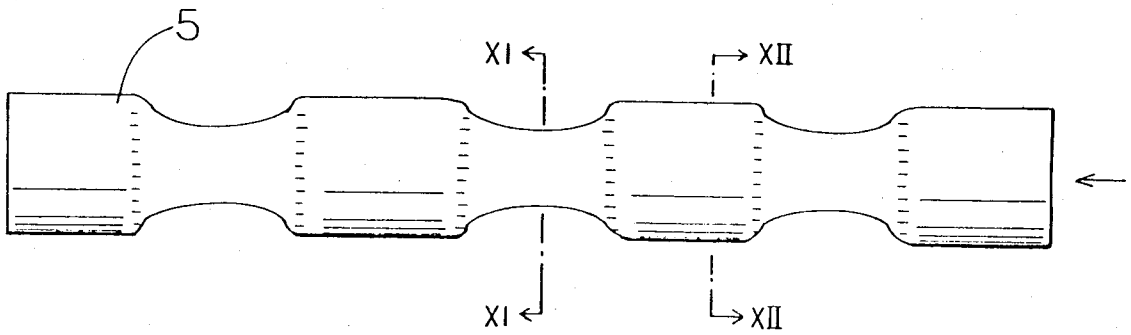
FIG. 5 shows another embodiment of the mixing pipe 5.
Figure 12:
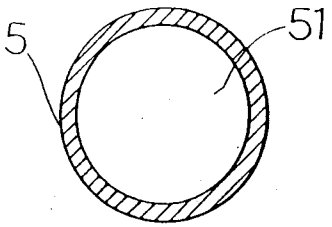
FIGS. 11 and 12 are cut-away cross-sectional views of the embodiment of the mixing pipe 5 shown in FIG. 5, taken along lines XI—XI and XII—XII, respectively.
Figure 11:
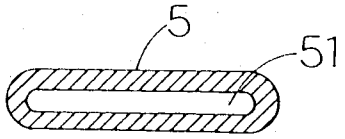

Alternatively, it is possible to combine different sections of the above examples and make a conduit of yet another shape, e.g. a normal cylindrical conduit incorporating a slit wringer as shown in FIGS. 5, 11, and 12.

Figure 6:
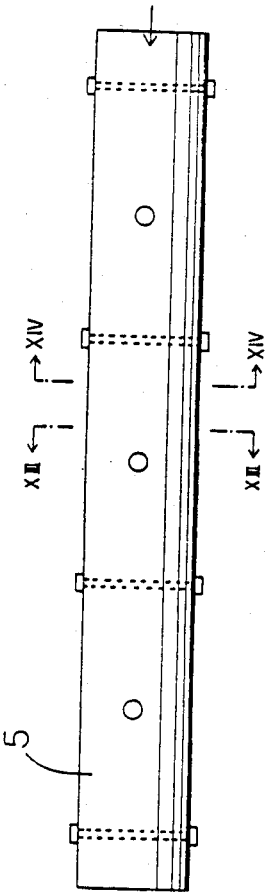
FIG. 6 shows yet another embodiment of the mixing pipe 5.
Figure 14:
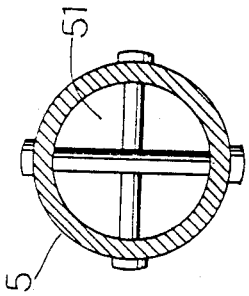
FIGS. 13 and 14 are cut-away cross-sectional views of the embodiment of mixng pipe 5 shown in FIG. 6, taken along lines XIII—XIII and XIV—XIV, respectively.
Figure 13:
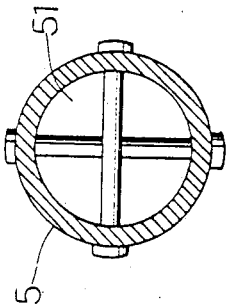

Or again alternatively, it is possible to use a regular cylindrical conduit 4 with turbulence creating blocking pins placed vertically and horizontally alternating at fixed distances as shown in FIGS. 6, 13, and 14.

The essential function of these obstructions is to have the energy of the travelling fluid create turbulence by interacting with conduit 51's non-smooth structure thus creating a mixing action.

As shown in FIGS. 1 and 2 pipe 31 is an air pressure transportation tube which drives granular substances by air pressure. This pipe is coupled to horizontally directed slit nozzle 3. To the vertically directed slit nozzle 4 is attached a pressure transporting pipe 14 that can transport one or multiple fluids at once.

It is possible to have transport pipe 41 carry and continuously mix, for example, a synthetic resin base and hardening agent.

From each of the pipes affixed to the respective nozzles a pre-determined liquid (this can be a granular substance too in the case of pipe 31) is pumped.

From nozzle 3 a belt-shaped effluence of granular strata 32 is discharged in the direction of mixing tube 5.

At the same time from nozzle 4 a strata of fluid 43 is jet sprayed downwards.

At a result, fluid strata 43 and granular strata 32 are applied to each other like coats of paint and the fluid strata 43 achieves a good permeation level with granular strata 32. In this permeated condition the combined strata are transported to mixing tube 5.

Next, as the fluid is transported to the brink and then into tube 5 a turbulence is created.

The reason for the creation of the turbulence is that the combined relatively unagitated flow from the respective nozzles encounters the wringer structure 52 and the fluid is compelled to radically change shape and local momentum.

As a result, a maelstrom is created and the fluid becomes extremely turbulent.

The now turbulent flow then encounters the next wringer structure 52 and again, compelled to change shape and local momentum, the mixing process is further advanced.

In this way, as the already well-mixed fluid passes through the conduit 51 it successively encounters wringer structures 52 and on each occasion is excited further. Consequently, even fluids of high viscosity are continuously and effectively agitated. An even and ideal mixture of agents is achieved.

The now thoroughly mixed fluid reaches the end of the mixing pipe 5 and is discharged from a spraying nozzle 8 attached to the end of the mixing pipe 5.

This spraying action of nozzle 8 is achieved solely with the energy of the pressure transported fluid itself.

This invention is intended to work as described in the above explanations. The following results may be anticipated:

[A] The respective fluids undertake a belt-like shape as they are sprayed at intersecting trajectories. As a result, a superior dispersion is achieved as the respective fluids mix.

Therefore the kinds of fluids and their respective properties do not have a noticable influence on the quality of the mix achieved. Normally, an even and good mix between agents is certain.

[B] The mixture of the fluids as well as their discharge from the mixing tube are effected utilizing only the energy resulting from their pressurized transport. Consequently no special mechanism to create turbulence or to eject the fluid is necessary. This an economical mixing method.

[C] This mixing method does not require any complicated machinery. Simply shaped horizontal and vertical nozzles and a counterpart mixing tube only are required.

Consequently, a small size machine for light or heavy-duty work is possible.

[D] A large quantity of the mixing agents are not used all at once. The desired quantity can be mixed and delivered at the desired speed by adjusting the speed of transport. In this way the mixture is delivered in the appropriate amounts at the appropriate speed.

[E] The wringer structures 52 are placed in the appropriate positions within the mixing tube 5 so that as the flow of fluid encounters a wringer the flow itself, interacting with the wringer, creates turbulence and an ideal mixture of agents results.

Consequently, the heretofore difficult to mix high viscosity fluids can achieve a mutual high level permeation.

[F] It is intended that this mixing method not be limited to use with construction or heavy duty machinery exclusively but that it should also be used with foods, medicines, and industrial materials as well. It is envisioned that this mixing and discharge method will have application in many fields.

[G] The fluid can be discharged from the mixing apparatus using only the kinetic energy of the fluid itself.

[H] When resin mortar is being mixed the ratio of the respective agents to each other can be adjusted so that the proper and even mix can achieved. As a result, the resin will have negligible run or drip when applied and the degree of variation in the resin quality itself will be minimal.

What is claimed is:

1. A method of mixing fluid and/or granular compositions, comprising the following steps:

introducing at least two substances, which are capable of being poured, in at least two planar non-parallel directions relative to each other, into a nozzle, said at least two substances being introduced in belt-shaped streams and undergoing initial mutual dispersion in said nozzle; and subsequently passing said at least two substances to a mixing tube having a varying internal cross-section along its length, whereby further mixture of said at least two substances is achieved.

2. A method as recited in claim 1, at least two of said planar non-parallel directions being perpendicular to each other.

3. A method as recited in claim 1, wherein said at least two substances are fed under pressure to said nozzle, the degree of pressure being variable, whereby said initial mutual dispersion of said at least two substances is carried out according to the viscosity of each of said at least two substances.

4. An apparatus for mixing fluid and/or granular compositions, comprising:

means for achieving initial mutual dispersion of at least two substances, said means for achieving initial mutual dispersion comprising means for introducing each of said at least two substances in belt-shaped streams in at least two planar non-parallel directions to a nozzle; and a mixing tube receiving the output of said nozzle, said mixing tube having a varying cross-section along its length, whereby further mutual dispersion of said at least two substances is achieved.

5. An apparatus as recited in claim 4, at least two of said planar non-parallel directions being horizontal and vertical.

6. An apparatus as recited in claim 4, said introducing means further comprising means for introducing each of said at least two substances under variable pressure to said nozzle, whereby said initial mutual dispersion of said at least two substances is carried out according to the viscosity of each of said at least two substances.

7. An apparatus as recited in claim 4, said mixing tube being compressed in different directions at different points along its length, whereby the cross-section of said mixing tube approximates an elliptical shape.

8. An apparatus as recited in claim 7, the elliptical shapes of consecutive compressions along the length of said mixing tube being such that the major axis of one of said consecutive compressions is perpendicular to the major axis of the other of said consecutive compressions.

9. An apparatus as recited in claim 4, the outside of said mixing tube being uniformly compressed at a plurality of points along the length of said mixing tube, such that at each of said plurality of points, a cross-section of said mixing tube has a smaller diameter than uncompressed portions of said mixing tube.

10. An apparatus for mixing fluid and/or granular compositions, comprising:

means for achieving initial mutual dispersion of at least two substances, said means for achieving initial mutual dispersion comprising means for introducing each of said at least two substances in belt-shaped streams in at least two planar nonparallel directions to a nozzle; and a mixing tube receiving the output of said nozzle, said mixing tube having blockage pins placed at different points along the length of said mixing tube, said blockage pins being disposed at different angles with respect to each other, whereby further mutual dispersion of said at least two substances is achieved.

11. An apparatus as recited in claim 10, consecutive ones of said blockage pins being positioned perpendicular to each other.

* * * * *